US007967430B2

(12) United States Patent
Freitag et al.

(10) Patent No.: US 7,967,430 B2
(45) Date of Patent: Jun. 28, 2011

(54) HEATED INK DELIVERY SYSTEM

(75) Inventors: Chad David Freitag, Portland, OR (US); Roger G. Leighton, Rochester, NY (US); Ivan A. McCracken, Portland, OR (US); Antonio St. Clair Lloyd Williams, Lake Oswego, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/498,165

(22) Filed: Jul. 6, 2009

(65) Prior Publication Data

US 2009/0273658 A1 Nov. 5, 2009

Related U.S. Application Data

(62) Division of application No. 11/644,617, filed on Dec. 22, 2006, now Pat. No. 7,568,795.

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS

| | | | | |
|---|---|---|---|---|
| 5,910,810 | A | 6/1999 | Brooks et al. | |
| 6,003,971 | A | 12/1999 | Hanks et al. | |
| 6,824,241 | B2 | 11/2004 | Sonnichsen et al. | |
| 6,860,591 | B2 | 3/2005 | Slotto et al. | |
| 6,994,430 | B2 | 2/2006 | Silverbrook | |
| 7,011,399 | B2 | 3/2006 | Godil et al. | |
| 7,568,795 | B2 * | 8/2009 | Freitag et al. | 347/88 |
| 2003/0063138 | A1 * | 4/2003 | Varnon et al. | 347/1 |
| 2005/0146584 | A1 | 7/2005 | Godil et al. | |
| 2006/0209146 | A1 | 9/2006 | Reeves | |

FOREIGN PATENT DOCUMENTS

WO 8808514 11/1988

OTHER PUBLICATIONS

EP Search Report, European Patent Office, Munich, DE, Apr. 24, 2008.

* cited by examiner

*Primary Examiner* — Laura E Martin

(74) *Attorney, Agent, or Firm* — Maginot, Moore & Beck LLP

(57) ABSTRACT

An ink umbilical provides different colors of heated ink to multiple print heads in an integrated structure. The ink umbilical includes a first and a second plurality of conduits, each conduit in the first and the second plurality of conduits having a flat surface between a first end and a second end of the conduit, and a heater having a first side and a second side, the flat surfaces of the conduits in the first plurality of conduits being coupled to the first side of the heater and the flat surfaces of the conduits in the second plurality of conduits being coupled to the second side of the heater to enable the heater to heat ink being carried between the first and the second ends of the conduits in the first and in the second plurality of conduits.

11 Claims, 3 Drawing Sheets

FIG. 3
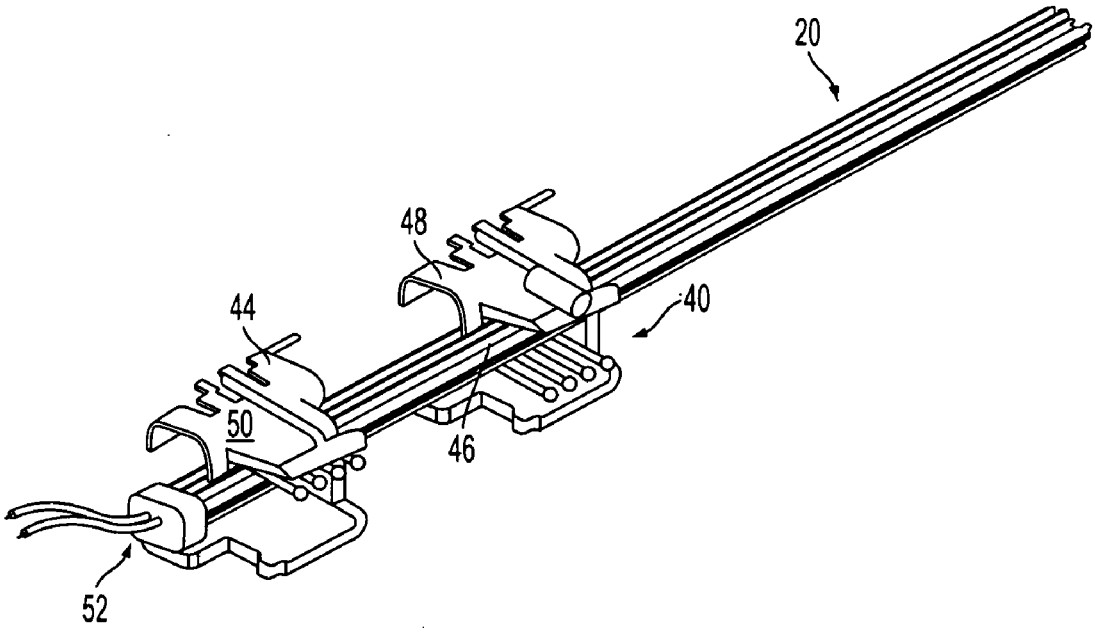
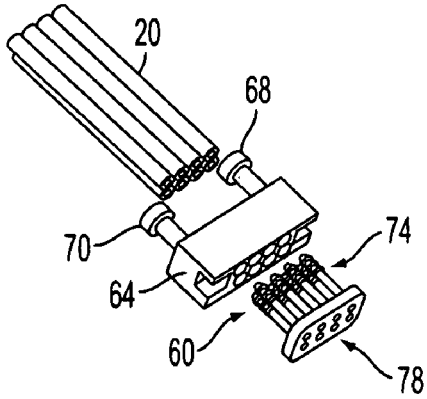
FIG. 4

HEATED INK DELIVERY SYSTEM

REFERENCE TO RELATED APPLICATIONS

This application is a divisional application of U.S. patent application Ser. No. 11/644,617, filed on Dec. 22, 2006, which is entitled "Heated Ink Delivery System." Reference is also made to commonly-assigned co-pending U.S. patent application Ser. No. 11/511,697, filed on Aug. 29, 2006, which is entitled "System And Method For Transporting Fluid Through A Conduit," the disclosure of which is hereby expressly incorporated in its entirety herein.

TECHNICAL FIELD

This disclosure relates generally to machines that pump fluid from a supply source to a receptacle, and more particularly, to machines that move thermally treated fluid from a supply through a conduit to a print head.

BACKGROUND

Fluid transport systems are well known and used in a number of applications. For example, heated fluids, such as melted chocolate, candy, or waxes, may be transported from one station to another during a manufacturing process. Other fluids, such as milk or beer, may be cooled and transported through conduits in a facility. Viscous materials, such as soap, lubricants, or food sauces, may require thermal treatment before being moved through a machine or facility.

One specific application of transporting a thermally treated fluid in a machine is the transportation of ink that has been melted from a solid ink stick in a phase change printer. Solid ink or phase change ink printers conventionally use ink in a solid form, either as pellets or as ink sticks of colored cyan, yellow, magenta and black ink, that are inserted into feed channels through openings to the channels. Each of the openings may be constructed to accept sticks of only one particular configuration. Constructing the feed channel openings in this manner helps reduce the risk of an ink stick having a particular characteristic being inserted into the wrong channel. U.S. Pat. No. 5,734,402 for a Solid Ink Feed System, issued Mar. 31, 1998 to Rousseau et al.; and U.S. Pat. No. 5,861,903 for an Ink Feed System, issued Jan. 19, 1999 to Crawford et al. describe exemplary systems for delivering solid ink sticks into a phase change ink printer.

After the ink sticks are fed into their corresponding feed channels, they are urged by gravity or a mechanical actuator to a heater assembly of the printer. The heater assembly includes a heater that converts electrical energy into heat and a melt plate. The melt plate is typically formed from aluminum or other lightweight material in the shape of a plate or an open sided funnel. The heater is proximate to the melt plate to heat the melt plate to a temperature that melts an ink stick coming into contact with the melt plate. The melt plate may be tilted with respect to the solid ink channel so that as the solid ink impinging on the melt plate changes phase, it is directed to drip into the reservoir for that color. The ink stored in the reservoir continues to be heated while awaiting subsequent use.

Each reservoir of colored, liquid ink may be coupled to a print head through at least one manifold pathway. As used herein, liquid ink refers to solid ink that has been heated so it changes to a molten state or liquid ink that may benefit from being elevated above ambient temperature. The liquid ink is pulled from the reservoir as the print head demands ink for jetting onto a receiving medium or image drum. The print head elements, which are typically piezoelectric devices, receive the liquid ink and expel the ink onto an imaging surface as a controller selectively activates the elements with a driving voltage. Specifically, the liquid ink flows from the reservoirs through manifolds to be ejected from microscopic orifices by piezoelectric elements in the print head.

Printers having multiple print heads are known. The print heads in these printers may be arranged so a print head need not traverse the entire width of a page during a printing operation. The print heads may also be arranged so multiple rows may be printed in a single operation. Each print head, however, needs to receive each color of ink in order to print the image portion allotted to the print head. One method of accomplishing this task requires each print head to have a separate feed channel and reservoir for each color. The typically large structure to accommodate this method, however, consumes too much space in the printer.

One approach is to couple each reservoir containing an ink color to all of the print heads in the printer. In a typical printer that uses four colors for printing, four reservoirs are provided with each reservoir collecting melted ink for one of the four colors. Thus, 4n connections are required to supply each print head with all of the printing colors, where n is the number of print heads. The resulting number of connections for printers having multiple print heads presents issues. One issue is the length of the connections to the various print heads. The distance from a more remote print head to a reservoir may be sufficient to allow the ambient air temperature to remove enough heat from the melted ink that the ink solidifies. To address this issue, each connection may be independently heated as disclosed in commonly assigned, co-pending U.S. patent application entitled "System For Maintaining Temperature Of A Fluid In A Conduit," which was filed on Dec. 20, 2006 and is identified by Ser. No. 11/642,801. Independently heating a significant number of connections, however, may adversely impact the energy efficiency of the printer. Therefore, a more cost effective structure for maintaining the temperature of melted ink in a plurality of connections between a plurality of print heads and a plurality of ink reservoirs would be useful.

SUMMARY

An ink umbilical provides different colors of heated ink to multiple print heads in an integrated structure. The ink umbilical includes a first plurality of conduits, each conduit in the first plurality having a flat surface that extends between a first end and a second end of the conduit, a second plurality of conduits, each conduit in the second plurality having a flat surface that extends between a first end and a second end of the conduit, and a heater having a first side and a second side, the flat surfaces of the first plurality of conduits being coupled to the first side of the heater and the flat surfaces of the second plurality of conduits being coupled to the second side of the heater to enable the heater to heat ink being carried between the first and the second ends of the first plurality of conduits and between the first and the second ends of the second plurality of conduits.

An ink delivery system for a phase change printer may incorporate the above-described ink umbilical to provide melted ink to a plurality of print heads. The ink delivery system includes a plurality of ink reservoirs, each reservoir containing an ink having a different color than ink in the other ink reservoirs of the plurality; a first plurality of conduits, each conduit in the first plurality having a flat surface between an inlet and an outlet of the conduit, each inlet of each conduit is coupled to only one of the reservoirs and each of the reservoirs are coupled to one of the conduit inlets in the first plurality of conduits, a second plurality of conduits, each conduit in the second plurality having a flat surface between an inlet and an outlet of the conduit, each inlet is coupled to only one of the reservoirs and each of the reservoirs are coupled to one of the conduit inlets in the second plurality of conduits, a heater having a first side and a second side, the flat surfaces of the first plurality of conduits being coupled to the first side of the heater and the flat surfaces of the second plurality of conduits being coupled to the second side of the heater to enable the heater to heat ink being carried between the inlet and the outlet of each conduit in the first plurality of conduits and to heat the ink being carried between the inlet and the outlet of each conduit in the second plurality of conduits, and a pair of print heads, one of the print heads being coupled to the outlet of each conduit in the first plurality of conduits to provide the print head with each color of ink contained in the plurality of reservoirs and the other print head being coupled to the outlet of each conduit in the second plurality of conduits to provide the other print head with each color of ink contained in the plurality of reservoirs.

BRIEF DESCRIPTION OF THE DRAWINGS

The foregoing aspects and other features of an fluid transport apparatus and an ink imaging device incorporating a fluid transport apparatus are explained in the following description, taken in connection with the accompanying drawings, wherein:

FIG. 3 is a partially exploded view of the ink umbilical shown in FIG. 2 having two print head connections.

FIG. 4 is a partially exploded view of a reservoir connection for coupling the ink umbilical of FIG. 2 to an ink reservoir.

DETAILED DESCRIPTION

Figure 1:
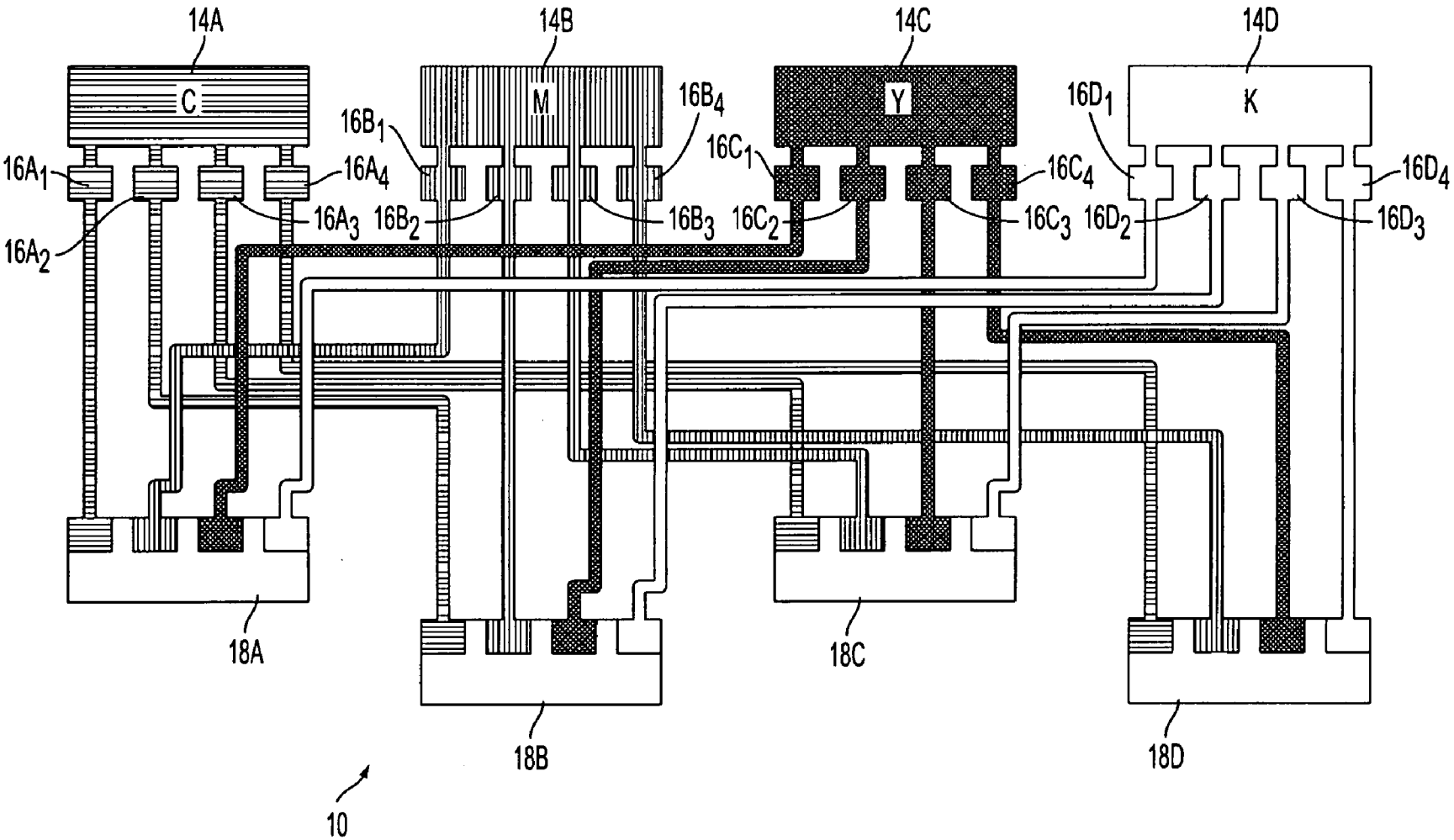
FIG. 1 is a block diagram of connections for an ink delivery system in a phase change ink printer.

A phase change ink printer may have four ink loader feed channels. Each channel of the ink loader ultimately produces colored ink for an associated color ink reservoir. A block diagram of the connections for a liquid ink delivery system that may be incorporated within such a printer is shown in FIG. 1. The system 10 includes reservoirs 14A, 14B, 14C, and 14D that are coupled to print heads 18A, 18B, 18C, and 18D through staging areas $\mathbf{16}A_{1\text{-}4}$, $\mathbf{16}B_{1\text{-}4}$, $\mathbf{16}C_{1\text{-}4}$, and $\mathbf{16}D_{1\text{-}4}$, respectively. Each reservoir collects melted ink for a single color. As shown in FIG. 1, reservoir 14A contains cyan colored ink, reservoir 14B contains magenta colored ink, reservoir 14C contains yellow colored ink, and reservoir 14D contains black colored ink. FIG. 1 shows that each reservoir is coupled to each of the print heads to deliver the colored ink stored in each reservoir. Consequently, each print head receives each of the four colors: black, cyan, magenta, and yellow, although other colors may be used for other types of color printers. The melted ink is held in the high pressure staging areas where it resides until a print head requests additional ink. The spatial relationship between reservoirs and print heads are shown in close proximity in the schematic such that the run length of parallel grouping is not illustrated.

FIG. 1 emphasizes connection points for a plurality of overlapping conduits between the reservoirs and the print heads. While independent conduit lines may be used to couple the reservoirs to each of the print heads, such a configuration is very inefficient for routing and retention. Actual distances between the reservoirs and heads are much longer. Also, the longest conduit lines, such as the one between the black ink reservoir 14D and the print head 18A, for example, may be sufficiently long that under some environmental conditions the ink may solidify before it reaches its target print head. Conduits must be flexibly configured and attached to one another to allow relative motion for printer operation and reasonable service access. To address these and other issues, an ink umbilical assembly, such as the umbilical assembly 20 shown in FIG. 2, has been developed. Umbilical assembly refers to a plurality of conduit groupings that are assembled together in association with a heater to maintain the ink in each plurality of conduits at a temperature different than the ambient temperature. The term conduit refers to a body having a passageway through it for the transport of a liquid or a gas. The exemplary umbilical assembly 20 described in more detail below is flexible to enable relative movement between adjacent print heads and between print heads and reservoirs.

Figure 2:
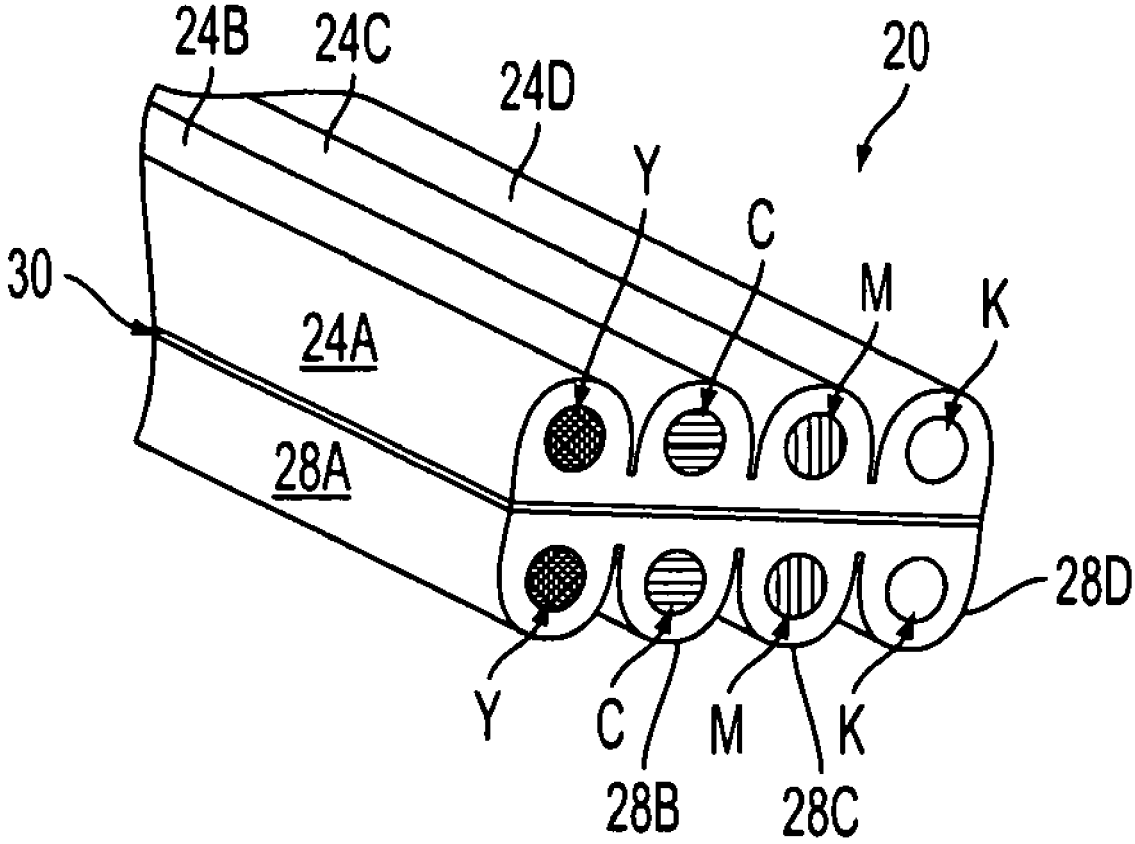
FIG. 2 is an enlarged perspective view of an ink umbilical used to implement the connections of the ink delivery system shown in FIG. 1.

The ink umbilical 20 of FIG. 2 includes a first grouping or set of conduits 24A, 24B, 24C, and 24D and a second set of conduits 28A, 28B, 28C, and 28D. Sandwiched between the first and the second set of conduits is a heater 30. Each set of conduits may be comprised of independent conduits that are coupled together at each end of the conduits in a set so the conduits are generally parallel to one another along the length of the ink umbilical. In another embodiment, the conduits may be extruded in a single structure as shown in FIG. 2. The conduits are preferably semi-circular to provide a relatively flat surface that facilitates the joining of the conduits to a heater as described in more detail below. This structure promotes transfer of heat into the tubes. Additionally, placing conduits on both sides of the heater makes efficient use of the heater. This configuration also provides thermal mass around the heater to improve heat spread and to reduce the likelihood of hot spots and excessively high skin temperatures behind the external insulation jacket.

Each conduit in each set of conduits is coupled at an inlet end to a color ink reservoir and at an outlet end to a print head. This enables the color conduit lines to remain grouped up to the point where they connect, which helps maintain thermal efficiency. As used herein, coupling refers to both direct and indirect connections between components. All of the outlet ends of a set of conduits are coupled to the same print head. As shown in FIG. 2, conduits 24A and 28A are coupled to the yellow ink reservoir, conduits 24B and 28B are coupled to the cyan ink reservoir, conduits 24C and 28C are coupled to the magenta ink reservoir, and conduits 24D and 28D are coupled to the black ink reservoir. Other possible combinations are, of course, possible.

The heater 30 includes an electrical resistance that may be in the form of a resistive heater tape or wire that generates heat in response to an electrical current flowing through the heater. The heater elements may be covered on each side by an electrical insulation having thermal properties that enable the generated heat to reach the conduits in adequate quantities to maintain melted ink in the conduits at an appropriate temperature. In one embodiment, the heater 30 is a Kapton heater made in a manner described in more detail below. Alternate heater materials and constructions, such as a silicone heater, may be used for different temperature environments, or to address cost and geometry issues for the construction of other embodiments of umbilical assemblies.

The heater 30, in one embodiment, has multiple zones with each zone generating a particular watt-density. The heater may be formed by configuring serpentine resistive heating traces on a non-conductive substrate or film. The serpentine resistive heating traces may be formed with INCONEL®, which is available from known sources. The watt-density generated by the heating traces is a function of the geometry and number of traces in a particular zone as well as the thickness and width of the INCONEL traces. After the heating traces are appropriately configured for the desired watt-density, a pair of electrical pads, each one having a wire extending from it, is coupled to the heating traces. The wires terminate in connectors so an electrical current source may be coupled to the wires to complete a circuit path through the heating traces. The current causes the heating traces to generate heat. The substrate on which the heating traces are placed may then be covered with an electrical insulation material, such as Kapton. The electrical insulation material may be bonded to the substrate by an adhesive, such as PFA, or by mechanical fasteners.

To keep the heater 30 from self-destructing from high localized heat, the heater may be coupled to a thermally conductive strip to improve thermal uniformity along the heater length. The thermal conductor may be a layer or strip of aluminum, copper, or other thermally conductive material that is placed over the electrically insulated heating traces. The thermal conductor provides a highly thermally conductive path so the thermal energy is spread quickly and more uniformly over the mass. The rapid transfer of thermal energy keeps the trace temperature under limits that would cause or result in damage, preventing excess stress on the traces and other components of the assembly. Less thermal stress results in less thermal buckling of the traces, which may cause the layers of the heater to delaminate. In one embodiment, the heater may be formed as a layer stack-up with the following layers from an upper surface of the heater to its lower surface: Kapton pressure sensitive adhesive (PSA), aluminum foil, fluorinated ethylene-propylene (FEP), Kapton, FEP, INCONEL, FEP, Kapton, aluminum foil, and Kapton PSA. Thus, the material stack-up for this embodiment is symmetrical about the INCONEL traces, although other configurations and materials may be used.

After the heater 30 has been constructed, it has an upper side and a lower side, both of which are relatively flat. One set of conduits is applied to the upper side of the heater 30. The set of conduits may be adhesively bonded to the heater using a double-sided pressure sensitive adhesive (PSA). Likewise, the other set of conduits are bonded to the lower side of the heater 30. This construction enables the two sets of conduits to share a heater that helps maintain the ink within the conduits in the liquid state. In one embodiment, the heater is configured to generate heat in a uniform gradient to maintain ink in the conduits within a temperature range of about 100 degrees Celsius to about 140 degrees Celsius. The heater 30 may also be configured to generate heat in other temperature ranges. The heater is capable of melting ink that has solidified within an umbilical, as may occur when turning on a printer from a powered down state.

FIG. 3 shows the ink umbilical 20 having two print head connectors 40, 44 coupled to it. The print head connectors, in one embodiment, are rigid plastic housings 48, 50. Within each housing is a plurality of ink nozzles, one nozzle for each conduit in a set of conduits. The ink nozzles 46 of the print head connector 40 are coupled to the conduits in the first set of conduits in the umbilical 20 and the ink nozzles of the print head connector 44 are coupled to the conduits in the second set of conduits in the umbilical 20. The ink nozzles may be fabricated from aluminum and constructed with an integrated barb at each end. The barbs, which provide a positive seal press fit, are pushed into a conduit to enable flow from a conduit through the nozzle. The silicone tubing, in one embodiment, expands over the barb to help seal the coupling. The ink nozzles of the print head connector 40 may be coupled to one of the print heads in a printer while the ink nozzles of the print head connector 44 may be coupled to another one of the print heads in the printer. In this manner, a single ink umbilical having multiple conduit groupings provides all the colors in the color ink reservoirs to two print heads. The ink umbilical shown in FIG. 3 includes an electrical connection 52 at its terminating end for coupling an electrical current source to the heater 30.

FIG. 4 shows an exploded view of a reservoir connector 60 for coupling the ink umbilical 20 to each of the color ink reservoirs. The reservoir connector 60, in one embodiment, includes a rigid plastic housing 64, a pair of fasteners 68, 70 for coupling the connector to structure within the printer, a set of ink nozzles 74 for each set of conduits in the umbilical 20, and a gasket 78. The connector 60 shown in FIG. 4 includes only one set of ink nozzles to facilitate viewing of the connector's structure. Each set of ink nozzles 74 includes an ink nozzle for each conduit in a set of conduits. One end of each ink nozzle in the set of ink nozzles in the reservoir connector 60 is coupled to one of the conduits in one set of conduits in the umbilical 20. The other end of each ink nozzle in a set of ink nozzles in the reservoir connector 60 is coupled to one of the color ink reservoirs. The integrated barbs, noted above, enable appropriate coupling of the ink nozzles. In this manner, the inlets for each set of conduits in the ink umbilical 20 are coupled to all of the colors in the color ink reservoirs. The reservoir connector 60 shown in FIG. 3 also includes a gasket that surrounds all of the ink nozzles. The gasket helps ensure a sealing connection between an ink nozzle and an outlet from an ink reservoir.

In operation, an ink umbilical has a reservoir connector mated to the inlet end of the umbilical at one end. Each ink nozzle in the reservoir connector is coupled to an ink reservoir and the connector is fastened to structure within the printer. A print head connector is mounted about the umbilical proximate the inlets of a print head. For an umbilical having two sets of conduits, another print head connector is mounted about the umbilical proximate the inlets of the second print head. The print head connectors are then coupled to the respective print heads. An electrical current source is then coupled to the electrical connector at the terminating end of the umbilical. A second ink umbilical may be coupled to another two print heads and to the color ink reservoirs to provide ink to another pair of print heads.

Thereafter, ink pumped from the ink reservoirs enters the sets of conduits in an umbilical. A controller in the printer couples the current source to the heater in the umbilical and the heater generates heat for maintaining the ink in its liquid state. The ink from one set of conduits is delivered to the print head coupled to them while ink from the other set of conduits is delivered to the print head coupled to them. Thus, ink is reliably delivered to multiple print heads in liquid form.

Those skilled in the art will recognize that numerous modifications can be made to the specific implementations of the ink umbilical described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. An ink delivery system for transporting ink to a pair of print heads comprising:

a plurality of ink reservoirs, each reservoir containing an ink having a different color than ink in the other ink reservoirs of the plurality;

a first plurality of conduits, each conduit in the first plurality having a flat surface between an inlet and an outlet of the conduit, each inlet of each conduit is coupled to only one of the reservoirs and each of the reservoirs are coupled to one of the conduit inlets in the first plurality of conduits;

a second plurality of conduits, each conduit in the second plurality having a flat surface between an inlet and an outlet of the conduit, each inlet is coupled to only one of the reservoirs and each of the reservoirs are coupled to one of the conduit inlets in the second plurality of conduits;

a heater having a first side and a second side, the flat surfaces of the first plurality of conduits being coupled to the first side of the heater and the flat surfaces of the second plurality of conduits being coupled to the second side of the heater to enable the heater to heat ink being carried between the inlet and the outlet of each conduit in the first plurality of conduits and to heat the ink being carried between the inlet and the outlet of each conduit in the second plurality of conduits;

a first pair of print heads, one of the print heads in the first pair of print heads being coupled to the outlet of each conduit in the first plurality of conduits to provide the print head with each color of ink contained in the plurality of reservoirs and the other print head in the first pair of print heads being coupled to the outlet of each conduit in the second plurality of conduits to provide the other print head with each color of ink contained in the plurality of reservoirs;

a third plurality of conduits, each conduit in the third plurality having a flat surface between an inlet and an outlet for the conduit, each inlet being coupled to only one of the reservoirs and each of the reservoirs being coupled to one of the conduit inlets in the third plurality of conduits;

a fourth plurality of conduits, each conduit in the fourth plurality having a flat surface between an inlet and an outlet for the conduit, each inlet being coupled to only one of the reservoirs and each of the reservoirs being coupled to one of the conduit inlets in the fourth plurality of conduits;

a second heater having a first side and a second side, the flat surfaces of the conduits in the third plurality of conduits being coupled to the first side of the second heater and the flat surfaces of the conduits in the fourth plurality of conduits being coupled to the second side of the second heater to enable the second heater to heat ink being carried between the inlets and the outlets of the third plurality of conduits and to heat ink being carried between the inlets and the outlets of the fourth plurality of conduits; and a second pair of print heads, one of the print heads of the second pair being coupled to the outlet of each conduit in the third plurality of conduits to provide the print head with each color of ink contained in the plurality of reservoirs and the other print head of the second pair being coupled to the outlet of each conduit in the fourth plurality of conduits to provide the other print head with each color of ink contained in the plurality of reservoirs.

2. The ink delivery system of claim 1, the first plurality of conduits being coupled together at the inlet of each conduit and at the outlet of each conduit.

3. The ink delivery system of claim 2, the second plurality of conduits being coupled together at the inlet of each conduit and at the outlet of each conduit.

4. The ink delivery system of claim 1, the conduits in the first plurality of conduits being substantively parallel to one another from the inlet of each conduit to the outlet of each conduit.

5. The ink delivery system of claim 4, the conduits in the second plurality of conduits being substantively parallel to one another from the inlet of each conduit to the outlet of each conduit.

6. The ink delivery system of claim 1, the heater being a Kapton heater.

7. The ink delivery system of claim 6, the Kapton heater having a plurality of heating zones.

8. The ink delivery system of claim 7 wherein the heating zones generate a substantially uniform temperature gradient along a substantial length of the heater intermediate the inlets of the conduits in the first and the second plurality of conduits and the outlets of the conduits in the first and the second plurality of conduits.

9. The ink delivery system of claim 1, the second heater being a Kapton heater.

10. The ink delivery system of claim 9, the Kapton heater having a plurality of heating zones.

11. The ink delivery system of claim 10 wherein the heating zones generate a uniform temperature gradient along the second heater from the inlets of the conduits in the third and the fourth plurality of conduits to the outlets of the conduits in the third and the fourth plurality of conduits.

* * * * *